US005350077A

United States Patent [19]

Nezu et al.

[11] Patent Number: 5,350,077

[45] Date of Patent: Sep. 27, 1994

[54] METHOD AND DEVICE FOR COUPLING A SELF-PROPELLED TRUCK WITH A CARRYING TRUCK

[75] Inventors: Takashi Nezu; Minoru Iwagami; Hisayoshi Kawashima, all of Ohme, Japan

[73] Assignee: Taichi-S Co., Ltd., Tokyo, Japan

[21] Appl. No.: 75,091

[22] Filed: Jun. 11, 1993

[51] Int. Cl.[5] ..... B61G 1/28

[52] U.S. Cl. ..... 213/75 R; 180/168; 280/508; 213/188; 213/211

[58] Field of Search ..... 213/75 R, 188, 189, 213/205, 211, 213; 180/168; 280/508

[56] References Cited

U.S. PATENT DOCUMENTS 2,481,461 9/1949 Wolfrum ..... 280/508
3,682,325 8/1972 Peterson et al. ..... 213/211
4,228,907 10/1980 Werner ..... 213/211 X
4,344,542 8/1982 Knight ..... 213/188
5,183,284 2/1993 Paplinski ..... 280/508

*Primary Examiner*—Robert J. Oberleitner
*Assistant Examiner*—S. Joseph Morano
*Attorney, Agent, or Firm*—Browdy and Neimark

[57] ABSTRACT

Method and device for coupling a self-propelled truck with a carrying truck, wherein the self-propelled truck is provided with a female engagement member having right and left catching spacings, whereas the carrying truck is provided with a male engagement pin, and wherein, while the self-propelled truck is moving along a rectilinear or curved path, the male engagement pin is caught and engaged in one of the right and left catching spacings, thereby effecting automatic, unmanned coupling of those two trucks. Also, an uncoupling arrangement is provided by disposing an uncoupling stand member at a proper uncoupling point and an uncoupling arm member at the self-propelled truck.

18 Claims, 8 Drawing Sheets

METHOD AND DEVICE FOR COUPLING A SELF-PROPELLED TRUCK WITH A CARRYING TRUCK

BACKGROUND OF INVENTION

1. Field of Invention

The present invention relates to a method for coupling and uncoupling a self-propelled truck with a carrying truck on which articles and goods are loaded, and a device for effecting the same.

2. Description of Prior Art

Most of large industrial factories and storehouses are equipped with some self-propelled trucks and carrying trucks to be coupled therewith as an indoor automated transfer means for transferring goods and articles to a destination in production lines or a storage section.

In general, the self-propelled truck has a self-driving mechanism comprising driving wheels, a motor operatively connected to the driving wheels, and a photo-sensitive guidance; and control system, so that the truck moves by itself moves along a given path labelled by a light reflecting tape. This self-propelled truck is provided with a device for coupling and uncoupling it with a carrying truck which is adapted for carrying articles thereon.

However, a known device for coupling the self-propelled truck with the carrying truck is constructed by a pair of male and female engagement elements, one of them being provided at the self-propelled truck and another of them provided at the carrying truck. In most cases, those two separate engagement elements require a connecting pin for locking their mutual engagement to complete the coupling between the self-propelled truck with the carrying truck. As a result, there is a need and annoying labor on the part of workers to follow quite a few steps of engaging and disengaging the two engagement elements by inserting and removing the connecting pin thereto and therefrom.

Further, at each uncoupling point or each point where the articles are unloaded from the carrying truck, the self-propelled truck has to be stopped manually by a worker assigned only for that purpose. On the way to a terminal point, such stop points are set with a limited short stoppage time, considering an automated production line or continuous work line, and the workers must finish loading or unloading the articles or goods from the trucks during such limited stoppage time. The workers suffer from undesired tension state for long time and will fail to pursue the all loading or unloading process, causing a problem of unstable production line and also giving no guarantee to the safety of each worker.

The conventional coupler for coupling the self-propelled truck with the carrying truck(s) has been formed in a relatively large size containing a means for solving the above-stated problems. But, this results in enlarging the width of the path along which the coupled trucks moves and thus taking much of room in the space of the factory or storehouse.

SUMMARY OF THE INVENTION

In view of the foregoing drawbacks, it is thus primary purpose of the present invention to provide a novel method which permits fully automated coupling of a self-propelled truck with a carrying truck without any intermitted stoppage.

In order to achieve such purpose, in accordance with the present invention, there is basically provided the steps of:

providing female and male engagement means at the rearward side of a self-propelled truck and at the forward side of a carrying truck, respectively;

wherein the female engagement means is so formed as to have an engagement base portion for allowing engagement with the male engagement means and retaining the same therein, and a pair of right and left opening means disposed symmetrically relative to and continuous with the engagement base portion;

defining a curved point in a path along which the self-propelled truck moves; and locating the carrying truck adjacent to the curved point, such that the male engagement means provided at the forward side of the carrying truck is positioned at a path along which one of the right and left opening means is to be displaced when the self-propelled truck turns at the curved point, whereby, when the self-propelled truck turns at the curved point, the female engagement means is subject to a swerving motion in respect of a curved line at the curved point, bringing the one of the right and left opening means towards the male engagement means of the thus-located carrying truck, so that the male engagement means is caught in the one of the right and left opening means, and engaged and retained in the engagement base portion of the female engagement means.

As one aspect of the invention, in the foregoing method, said female engagement means may be swingable with respect to the self-propelled truck and returnable to a predetermined position under a biasing force of spring means, and the right and left opening means may be ojected beyond the respective lateral sides of said self-propelled truck, in order to attain the same coupling effect between the two trucks.

A second purpose of the present invention is to provide a device for carrying out the abovedescribed method.

To this end, the device, in accordance with the invention vention, basically comprises:

a male engagement means provided at a forward side of said carrying truck; and a female engagement means provided at a rearward side of said self-propelled truck, said female engagement means including:

(a) a base engagement portion for allowing engagement with said male engagement means and retaining the same therein;

(b) a pair of right and left opening means disposed symmetrically relative to and continuous with said engagement base portion;

(c) a spacing area which communicates said pair of right and left opening means with said base engagement portion; and (d) a stopper means provided movably at said base engagement portion, said stopper means being biased by a spring means in a direction to close said spacing area, In the above-constructed device, it may also be arranged such that the female engagement means is siwingable on a horizontal plate with respect to the self-propelled truck and returnable to a given position under a biasing of spring means, and that the right and left opening means not only projected beyond the respective lateral sides of self-propelled truck, but also opened towards the direction in which the truck moves.

In both method and device above, there may be provided an uncoupling means to uncouple the self-propelled truck from the carrying truck. Namely, a vertically movable means may be incorporated in one of the male and female engagement means, and an uncoupling stand means be located at an uncoupling point, so that when the coupled two trucks reach the uncoupling point, such stand means moves vertically one of the male and female engagment means away from another of them, to thereby uncouple the self-propelled truck from the carrying one.

Accordingly, the self-propelled truck moves on, without any stoppage, automatically effecting coupling-/uncoupling actions to transfer plural carrying trucks to ther respective destinations, in unmanned way.

Other features, advantages and uses will be obvious or become apparent from a consideration of the following detailed description and annexed drawings.

DETAILED DESCRIPTION OF PREFERRED EMBODIMENTS OF THE INVENTION

Figure 1:
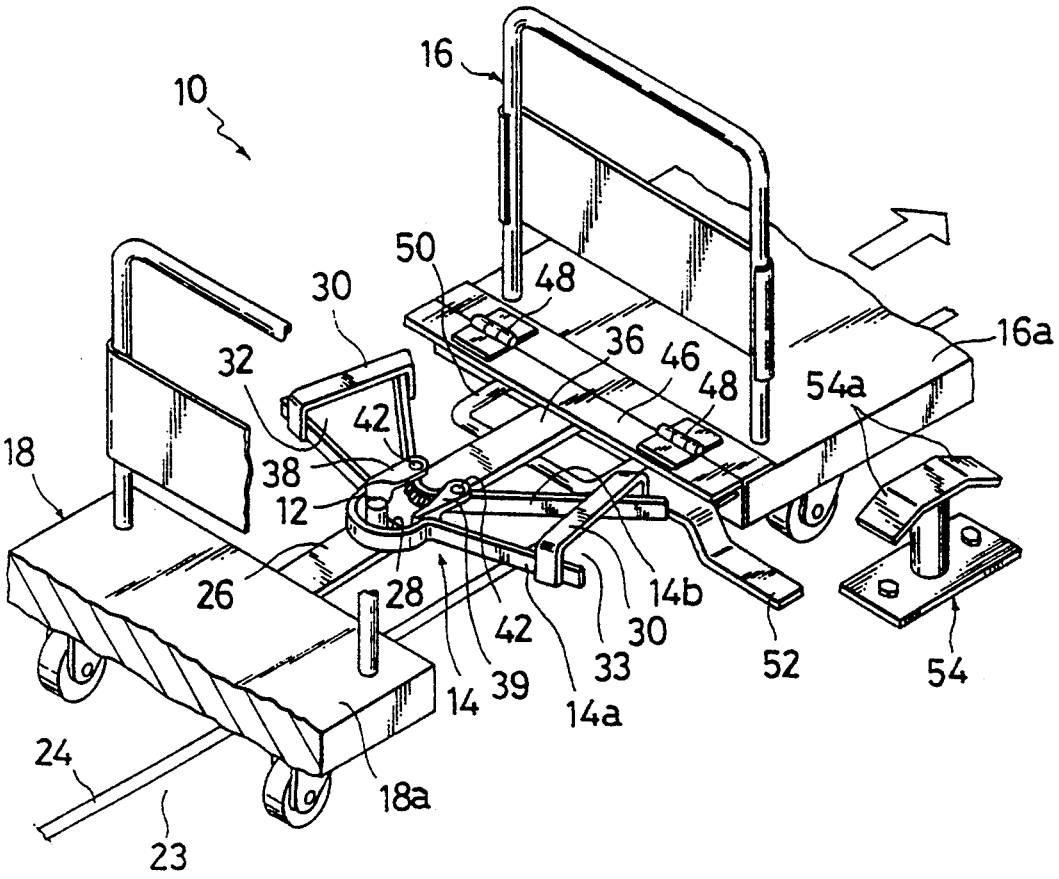
FIG. 1 is partly broken, schematic perspective view of a device for coupling a self-propelled truck with a carrying truck in accordance with the present invention.
Figure 2:
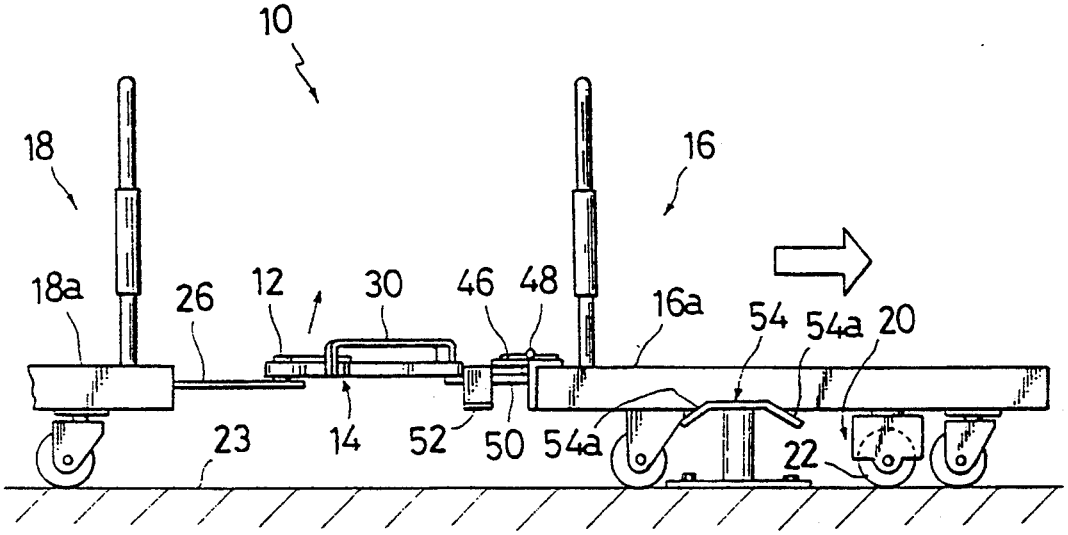
FIG. 2 is a schematic side view of the same device as in FIG. 1.

Referring to FIGS. 1 and 2, there is generally illustrated a coupler (10) for coupling and uncoupling a self-propelled truck (16) with a carrying truck (18).

Both self-propelled and carrying trucks (16)(18) are known trucks for automatically transferring some articles or goods to destinations in an industry factory or storehouse. In brief, the self-propelled truck (16) is provided with a drive mechanism (20) for moving the truck, in unmanned way, along a given running path. Although not shown, the drive mechanism (20) is of an ordinary known construction comprising a motor for rotating a driving wheel (22), a battery, a proper photo-sensitive guidance and control device for driving, turning or stopping the driving wheel (22) along a light reflecting tape (24) adhered on the floor (23). The photo-sensitive guidance and control device, as known in the art, includes a pair of light emitters for applying a light towards the light reflecting tape (24) and a light sensor for detecting the reflected light, to thereby determine a direction in which to guide the truck (16).

As shown, both trucks (16)(18) have their respective carrying bases (16*a*)(18*a*) upon which articles and goods are loaded, and their respective four wheels as with the ordinary carrier or carrying truck. However, the self-propelled truck (16) may be a self-propelled car or the like without such carrying base (16*a*).

Now, with particular reference to FIGS. 1 to to 4, in accordance with one embodiment of the coupler designated by (10) in the present invention, the carrying truck (18) has an arm (26) projecting horizontally from the forward end of the base (18*a*). An engagement pin (12) is fixed in an erect position on the free end portion of the arm (26), the pin (12) serving as a male engagement means relative to the leading self-propelled truck (16) as will be explained later.

On the other hand, the self-propelled truck (16) has an arm (36) projecting horizontally from the rearward end of the base (16*a*) in a direction towards the foregoing free end of the carrying truck arm (26). The arm (36) is however fixed at its base end to the hinge bracket (46) which in turn is fixed on the rearward end of base (16*a*). The hinge bracket (46) includes a pair of hinge elements (48)(48) for fixing one half of bracket on the base (16*a*) and allowing another half of same to be rotated vertically relative to the base (16*a*). The base end of the arm (36) is fixed to that rotatable half of hinge bracket (46), so that the arm (36) per se is free to rotate vertically in respect to the opposite arm (26) of carrying truck (18). Designation (50) denotes a support member (50) for supporting arm (36) and rotatable bracket half on a horizontal plane, as seen in FIG. 2. It is also noted from FIG. 2 that the arm (36) of self-propelled truck (16) is disposed on a line above the longitudinal axis of opposed arm (2*b*) of carrying truck (18) for a smooth mutual engagement purpose to be set forth later.

Figure 4:
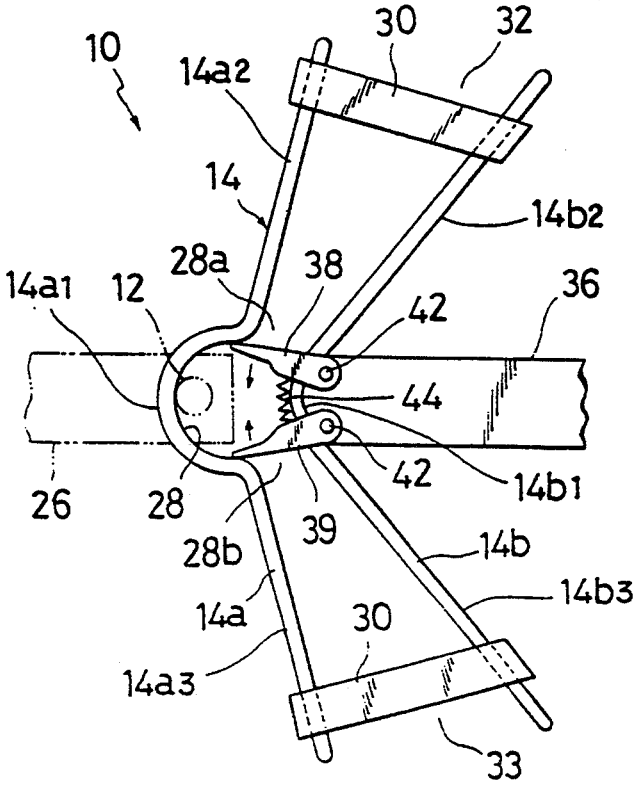
FIG. 4 is an enlarged plan view of a female engagement member of the device.

Provided to the free end of arm (36) at the self-propelled truck (16), is a female engagement member (14) to which is to be engaged or disengaged the foregoing male engagement pin (12) at the carrying truck (18). As best shown in FIG. 4, the female engagement member (14) is essentially composed of a generally V-shaped engagement piece (14*a*), a generally V-shaped support piece (14*b*), a pair of support brackets (30)(30) connecting the engagement piece (14*a*) with the support piece (14*b*) for firmly supporting the former (14*a*), and a pair of stoppers (38) (39) disposed centrally of those two pieces (14*a*) (14*b*).

The engagement piece (14*a*) is formed by a generally semi-circular central section (14*a*1) projecting most rearwardly of the truck (16) and a pair of inclined wing sections (14*b*2)(14*b*3) extending from the central section (14*a*1) in a manner diverging towards the rearward side of truck (16), like a wing expanding both ends symmetrically relative to the central section (14*a*1) to the extent substantially covering the width of the truck (16).

The support piece (14*b*) is fixed at its central section (14*b*1) to the free end of arm (36), extending both wing sections (14*b*2)(14*b*3) thereof in such diverging manner likewise as in the foregoing engagement piece's ones (14*b*2)(14*b*3). But, as shown, those support piece wing sections (14*b*2)(14*b*3) are bent at a greater angle relative to the central section (14*b*1) than the engagement piece ones (14*b*2)(14*b*3). In addition, both engagement and support pieces (14*a*) (14*b*) are spaced apart from each other by the two support brackets (30)(30). Accordingly, with this arrangement, as best seen in FIG. 4, between these two pieces (14*a*)(14*b*), there are defined a central engagement spacing (28) of generally circular shape where the above-stated engagement pin (12) of the carrying truck (18) is to be engaged with or disengaged from the female engagement member (14), and a pair of symmetrical lateral catching spacings (32)(33) which open gradually wider as they proceed in the outward direction from their respective narrow openings (28*a*)(28*b*) and act to catch the engagement pin (12) therein and guide the same towards the central engagement spacing (28), as will be elaborated later.

Referring again to FIG. 4, the two stoppers (38)(39) are pivotally connected by their respective pins (42)(42) to the free end of arm associated with the self-propelled truck (16), so that the free ends of the stoppers (38)(39) are rotatable relative to the pins (42)(42), respectively. These stoppers (38) (39) extend their free ends towards the central semi-circular section (14*a*1) of engagement piece (14*a*), crossing and closing the abovementioned two narrow openings (28*a*)(28*b*) laying adjacent the central catching spacing (28). As illustrated, normally, those two stoppers (38)(39) are so biased by a spring (44) as to rotate outwardly away from each other, keeping their respective free ends in contact with both neck or root portions of the engagement piece's semicircular section (14*a*1), thereby placing the central spacing (28) in a closed state. This biasing arrangement is not limitative, and any other sorts of spring or plural springs may be used insofar as they serve that purpose.

As best shown in FIG. 1, the coupler 14, in accordance with the present invention, further includes an uncoupling device designated by (52)(54). This uncoupling device comprises an uncoupling arm member (52) provided on the self-propelled truck (16) and an uncoupling stand member (54) which is fixed on the floor (23) at an uncoupling point in a certain continuous production line or the like. The uncoupling arm member (52) is fixed at its base end to the rotatable half of hinge bracket (46), so that the uncoupling arm member (52) is free to rotate vertically relative to the horizontal plane along which the the base (16*a*) extends. Hence, when the uncoupling arm member (52) is raised, all the arm (36) and engagement member (14) are also raised simultaneously.

The free end of the uncoupling arm member (52) is projected therefrom in a direction laterally from the truck (16). On the other hand, the uncoupling stand member (54) has an upper plate of generally inverted U-shaped configuration including both two opposed downwardly inclined guide surfaces (54*a*).

Figure 7:
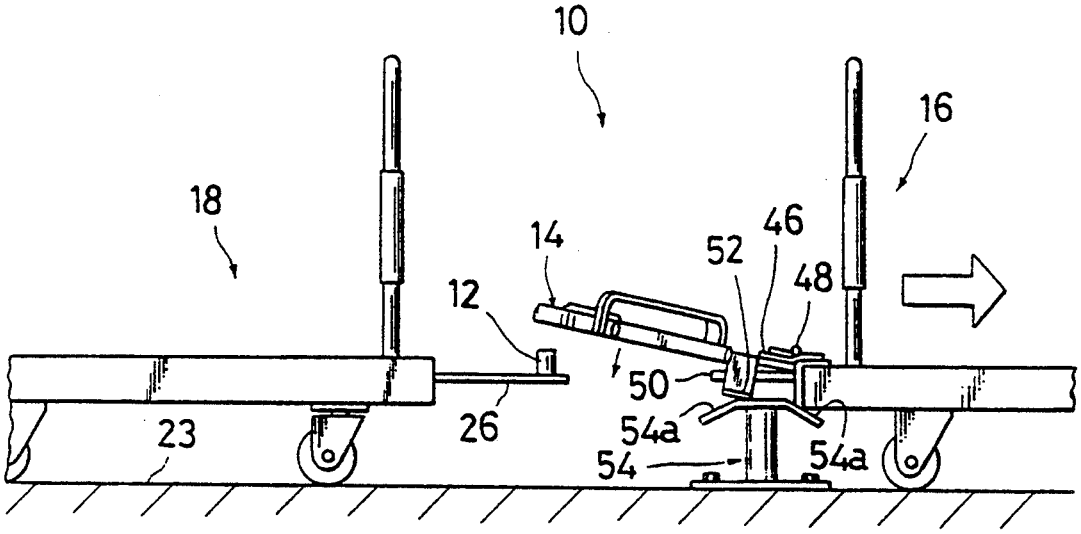
FIG. 7 is a schematic side view showing the uncoupled state between the two trucks.

Thus, when the self-propelled truck (16) reaches a given uncoupling point where the uncoupling stand member (54) lies, the free end of coupling arm member (52) contacts and rides on the uncoupling stand member (54), whereupon the female engagement member (14) is displaced upwardly relative to the hinge point at (48) and disengaged from the engagement pin (12), thereby uncoupling the self-propelled truck (16) from the carrying truck (18), as shown in FIG. 7.

In this respect, the free end of uncoupling member (52) must be disposed at a lower level than the top of the uncoupling stand member (54), the level being low enough to raise the female engagement member (14) away from engagement with the engagement pin (12) as in FIG. 7.

Figure 5:
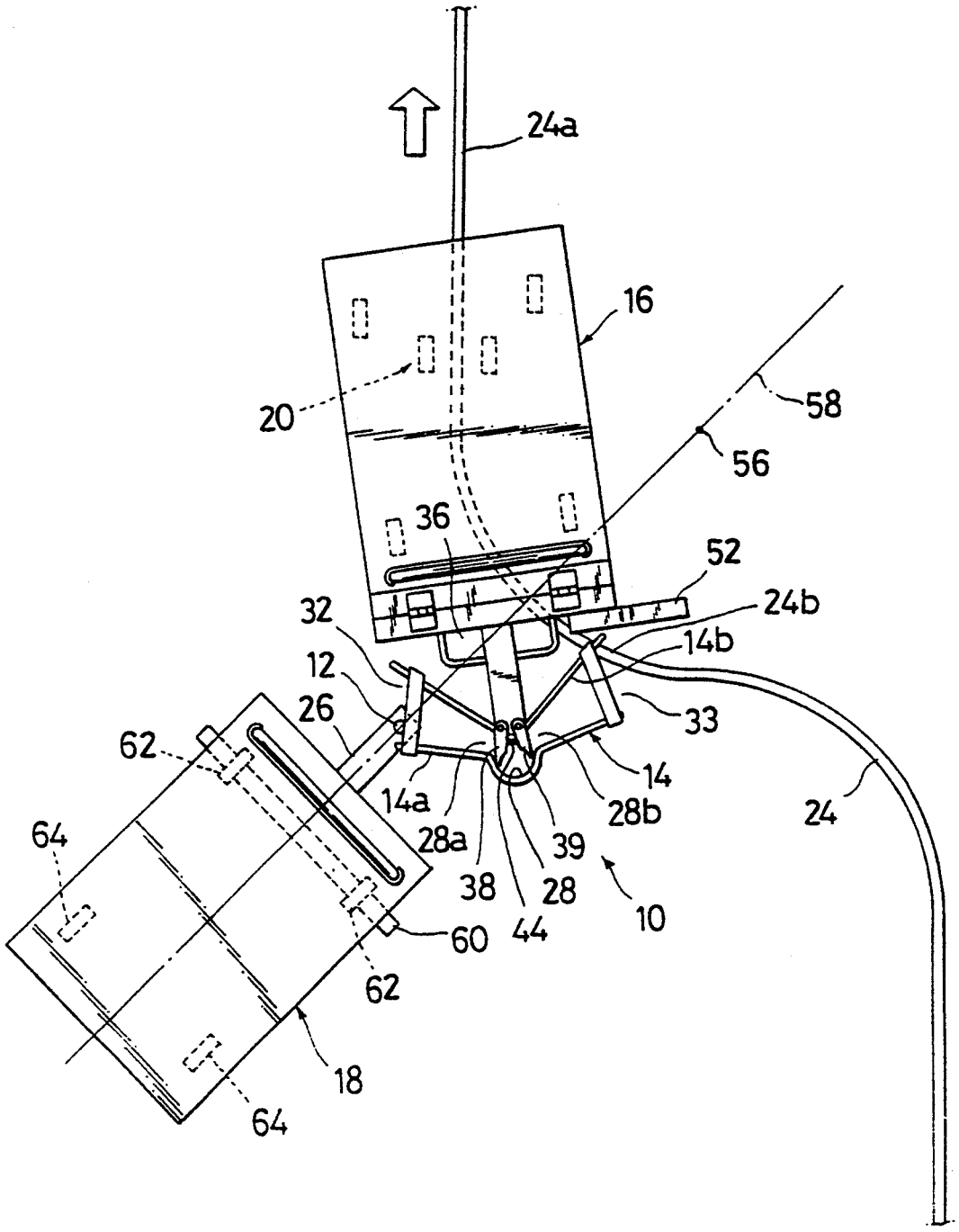
FIG. 5 is a plan view showing the state where the self-propelled truck is about to be coupled with the carrying truck.

Behind the above-described structure, the present invention focuses the swerving motion of the rearward end of self-propelled truck (16) relative to a given path, when it turns at a curved point as in FIG. 5. For that reason, the female engagement member (14) is disposed at the reaward end of truck (16). Namely, as understandable from FIG. 5, when the truck (16) turns at the curved point, the rearward end of truck (16) is swerved from the path set by a light reflecting tape (24), orienting the longitudinal axis of truck (16) in a direction generally tangential to a circle along which the curved portion (24*b*) of tape (24) extends, and as a result, the female engagement member (14) is simultaneously swerved in the likewise tangential direction. Consequently, as in FIG. 5, the female engagement member (14) is projected from the curved line of the tape curved portion (24*b*).

In accordance with the present invention, using the above-discussed swerving effect, a coupling point is defined at the curved point in the path on which the self-propelled truck (16) moves, so as to couple that leading truck (16) with the carrying truck (18).

Figure 6:
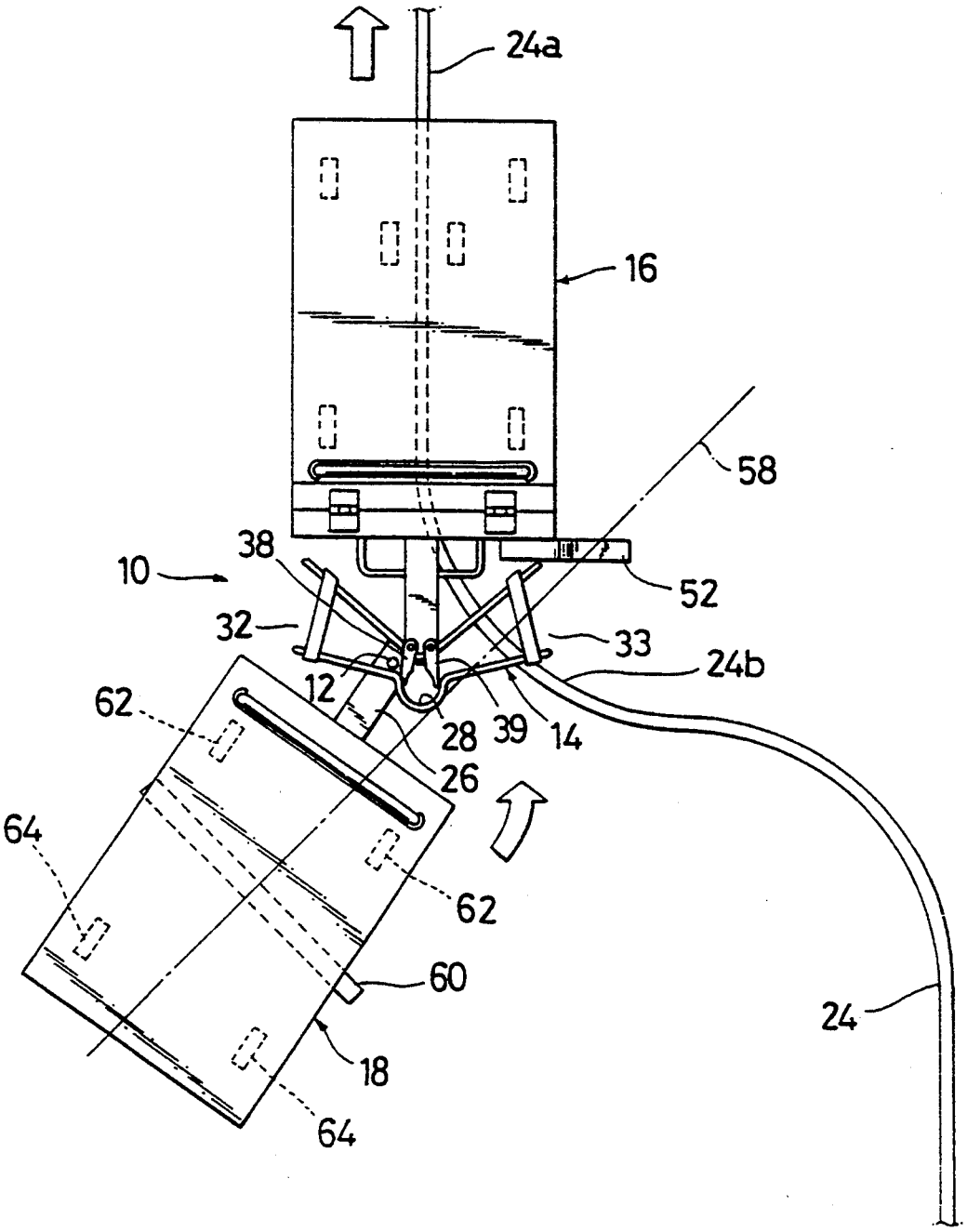
FIG. 6 is a plan view showing the state where the self-propelled truck has been coupled with the carrying truck.

More specifically, reference is made to FIGS. 5 and 6. The tape (24) is adhered on the floor in the illustrated manner including the curved portion (24*b*) and rectilinear portion (24*a*). According to the invention, such curved portion (24*b*) is set as a coupling point for coupling the self-propelled truck (16) with the carrying truck (18). In order to insure that coupling, a waiting line (60) is provided on the floor, at which the carrying truck (18) is located, waiting for coupling with the self-propelled truck (16).

In the present embodiment, the waiting line (60) is defined by drawing it orthogonally with a line (58) intersecting the point (56) which forms a center of circle along which the foregoing curved tape portion (24*b*) lies.

Here, let us firstly discuss the path on which the left-side catching spacing (32) of female engagement member (14) is moved, when the self-propelled truck (16) turns along the curved tape portion (24*b*). That is, as stated earlier, while the truck (16) turns along the curvature (24*b*), the longitudinal axis of that particular truck (16) moves in the tangential direction to the circle along the curvature (24*b*) lies, and thus, in this case, the left-side catching spacing (32) are displaced along a certain arc-like path outside the curvature (24*b*). Consequently, the engagement pin (12) must be located at a proper point on such arc-like path along which the left-side catching spacing (32) is to be displaced, in order to let the pin (12) in that catching spacing (32). The setting of the waiting line (60) requires considering those conditions to complete a smooth engagement between the pin (12) and engagement member (14).

Preferably, the line (58), by which the longitudinal direction of carrying truck (18) should be set with respect to the left-side catching spacing (32) of female engagement member (14), may intersect a vertical line corresponding to the rectilinear portion (24*a*) of tape (24), at the angle of 45 degrees.

As shown in FIG. 5, it is preferable to set the waiting line (60) at a position where the front two wheels (62)(62) of carrying truck (18) lie. The line (60) may be formed in a recessed line or projected line on the surface of floor at a proper level allowing the wheels (62) to easily ride over the line. This formation of line (60) makes it easier or more positive to set the carrying truck (18) at a given waiting line against movement before coupling it with the moving truck (16). But, the waiting line may be formed in any other suitable manner.

Looking now at FIG. 5, when the self-propelled truck (16) moves along the path set by the tape (24) and turns along the curved portion (24*b*) of the same tape (24), the engagement member (14) behind the truck (16) is subject to the above-discussed swerving motion and displaced along the arc-like path outside the tape curved portion (24*b*) towards the engagement pin (12) of carrying truck (18) located at the waiting line (60). In this way, just as viewed from FIG. 5, the pin (12) is caught in the left-side catching spacing (32) of engagement member (14), hence starting to couple the propelled truck (16) with the carrying one (18).

Figure 3:
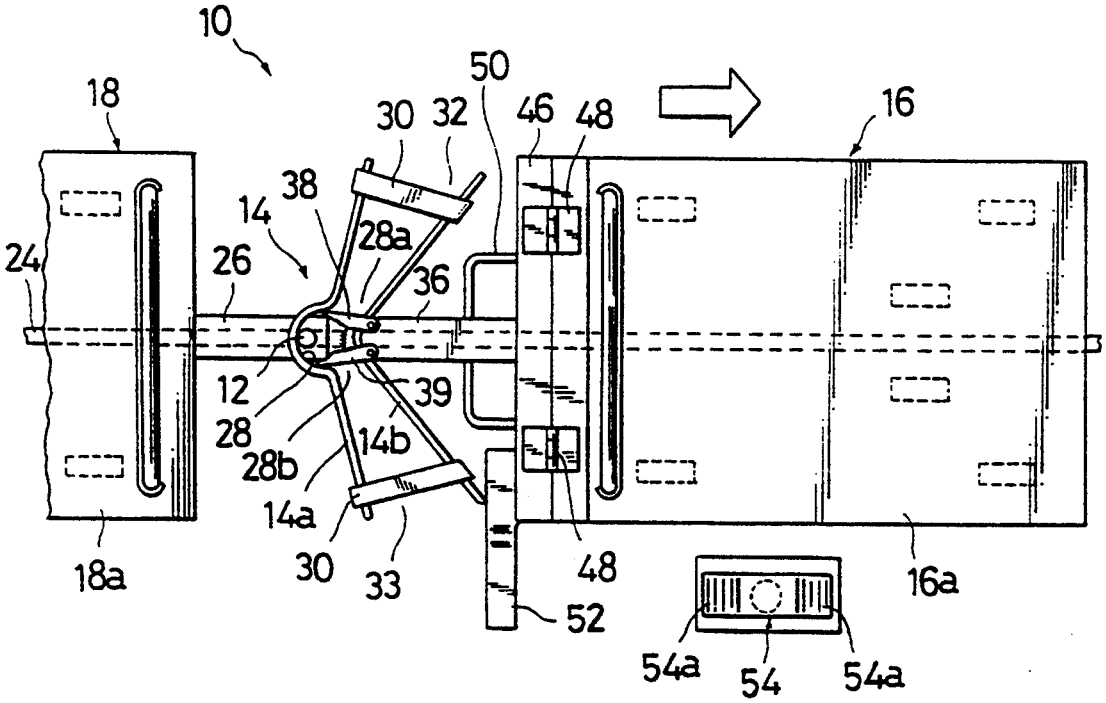
FIG. 3 is a schematic plan view of the device by which self-propelled and carrying trucks are coupled together.

Then, referring to FIG. 6 in conjunction with FIG. 5, as the self-propelled truck is turning towards the tape rectilinear portion (24*a*), the engagement pin (12) slides along the left-side part of engagement piece (14*a*) of engagement member (14) towards the central engagement spacing (28) thereof, while the carrying truck (18) is being drawn away from the waiting line (60). With further movement of truck (16), the engagement pin (12) pushes the stopper (38), overcoming the biasing force of spring (44), and passes through the narrow spacing (28*a*) to enter the central engagement spacing (28) of the engagement member (14). At this point, the stopper (38) is returned to close the narrow spacing (28*a*) by the spring, thereby enclosing the engagement pin (12) with the stoppers (38)(39) and semi-circular section (14*a*1) and thus placing the male engagement pin (12) in a locked state against removal from the female engagement member (14), as seen in FIGS. 1 to 3, whereupon the coupling of the two trucks (16)(18) is completed. The carrying truck (18) is transferred by the self-propelled truck (16) towards a destination in this unmanned way.

It is appreciated that the female engagement member (14) is only projected outwardly from the path when the self-propelled truck (16) turns along the curvature at (24*b*) for the coupling purpose, and normally, when the truck (16) runs on the rectilinear line at (24*a*), the female engagement member (14) is disposed within the width of the truck body, thus avoiding the projection of the member (14) per se along the running path, which advantageously permits for designing the path to have a narrower width and thus leaving a wider room of working space in the factory or storehouse.

Further, the female engagement member (14) directs the two catching spacings (32)(33) symmetrically on the right and left sides in relation to the path on which the self-propelled truck (16) moves, which thus allows setting the foregoing waiting line (60) at any of the right and left sides at a curved point, regardless of the embodiment shown in FIGS. 5 and 6.

When the self-propelled truck (16) trailing the carrying truck (18) reaches the previously stated uncoupling point where the uncoupling stand member (54) is located. As shown in FIG. 7, the uncoupling arm member (52) rides on the top of the stand member (54), causing the female engagement member (14) to be rotated upwardly relative to the hinge (48), thereby releasing the male engagement pin (12) from engagement with that female engagement member (14). Thus, the carrying truck (18) is stopped at the uncoupling point. But, in contrast thereto, the self-propelled truck (16) moves on forwardly in the arrow direction, with the uncoupling arm member (52) riding over the stand member (54), with the result that such arm member (52) leaves from the uncoupling member (54) and falls downwardly to the horizontal normal position limited by the support member (50), thus lowering and returning the female engagement member (14) to the same normal horizontal position.

With the above-described coupling and uncoupling manners, it may be so arranged that one self-propelled truck (16) moves on without any intermitted stoppage, continuing to transfer a desired number of separate carrying trucks (18) to their respective destinations in a production or working line.

Reference is now made to FIGS. 7 thorough 8 which show another embodiment of female engagement member in place of the above-described one (14), which is generally designated by (114).

This particular engagement member (114) is designed to effect the coupling of the self-propelled truck (16) with the carrying truck (18) along the rectilinear path as shown. It is noted that, except for this engagement member (114), all trucks and associated elements are identical to those described in the foregoing first embodiment, and all like designations to be given hereinafter correspond to all like ones used in the first embodiment.

The female engagement member (114) has a support arm member (136) whose base end is pivotally connected to a central area of a support base plate (74) fixed at the rotatable half of hinge bracket (46) at the side of self-propelled truck (16). The forward end of the support arm member (136) is fixed to the central part of a support rod (72). A pair of spaced-apart tension springs (70)(70) are extended between the support base plate (74) and support rod (72), such that two springs (70)(70) are disposed on the opposite sides of the support arm member (136), as shown.

The female engagement member (114) further comprises a generally V-shaped inward support piece (114*b*), a generally V-shaped outward engagement piece (114*a*), and a pair of stoppers (128*a*)(128*b*).

Figure 9:
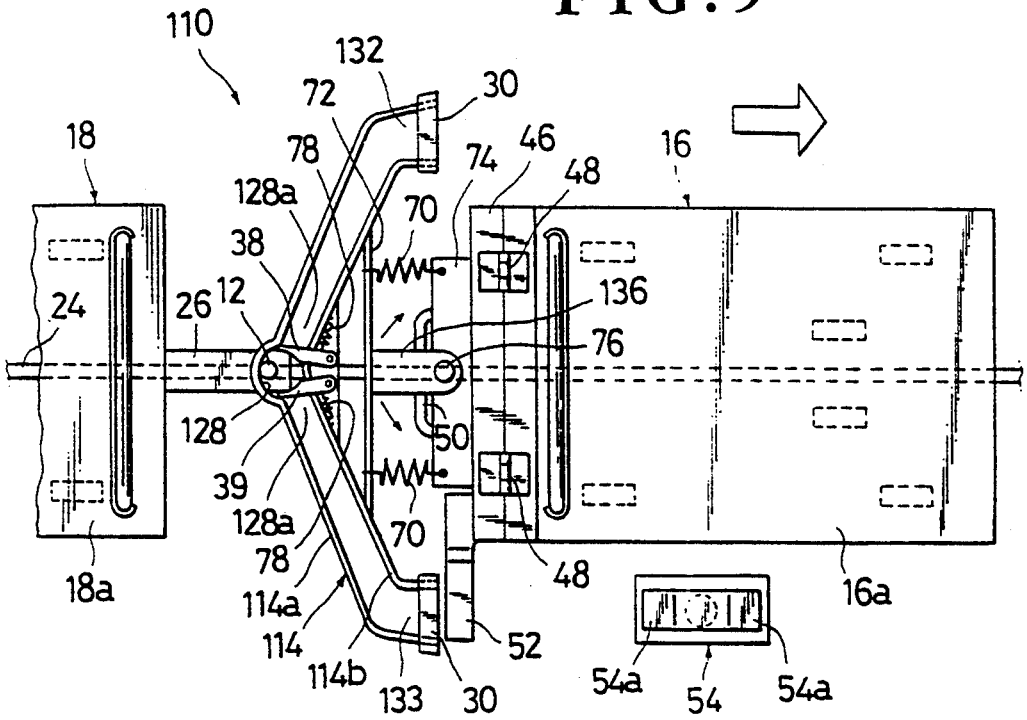
FIG. 9 is a plan view showing the another embodiment by which the trucks are coupled together.

As best seen from FIG. 9, both inward and outward pieces (114*b*)(114*a*) extends outwardly in a symmetrical way relative to a central line along which there lie the support arm member (13) and central longitudinal axis of self-propelled truck (16), and further projects beyond both lateral sides of the truck (16).

Both end portions of inward and outward pieces (114*b*)(114*a*) are bent in a direction parallel with the rectilinear tape (24) which corresponds to the above-stated central line.

Likewise as in the first embodiment, the engagement and support pieces (114*a*)(114*b*) are spaced apart from each other and connected together by the two brackets (30)(30) such as to define therebetween a central engagement spacing (128) and a pair of catching spacings (132)(133). The engagement spacing (128) is surrounded by the semi-circular central section of the engagement piece (114*a*) and the two stoppers (38)(39). The two stoppers (38)(39) are pivotally mounted at a flat support part formed at the pointed central portion of support piece (114*b*), as illustrated. In this embodiment, a pair of tension springs (78)(78) are provided there to biasingly rotate the respective stoppers (38)(39) away from each other, keeping their free ends in contact with the neck portions of the semi-circular central section of engagement piece (114*a*) so as to close both narrow spacings (128*a*)(128*b*) between the central engagement spacing (128) and two laterally extending catching spacings (132)(133).

As shown, those two catching spacings (132)(133) are each gradually diverged as they proceed outwardly and terminates in forming a longitudinal spacing substantially in parallel with the longitudinal direction of truck (16), which opens in the direction wherein the truck (16) moves as can be seen in FIG. 9.

Both ends of the support rod (72) are fixed to both inclined sections of the support piece (114*b*), respectively, whereby the engagement piece (114*a*) as well as the support one (114*b*) are free to swingingly move on the horizontal plane relative to the pivot point (76) between the right and left sides of the self-propelled truck (16). But, such swinging movability is normally restricted by the two tension springs (70)(70). Namely, the tension springs (70) (70) exert a same biasing force to the respective right and left sides of both engagement and support pieces (114*a*)(114*b*), thus providing an equilibrium action to resiliently retain them at a central line against movement in any of right and left directions.

Figure 11:
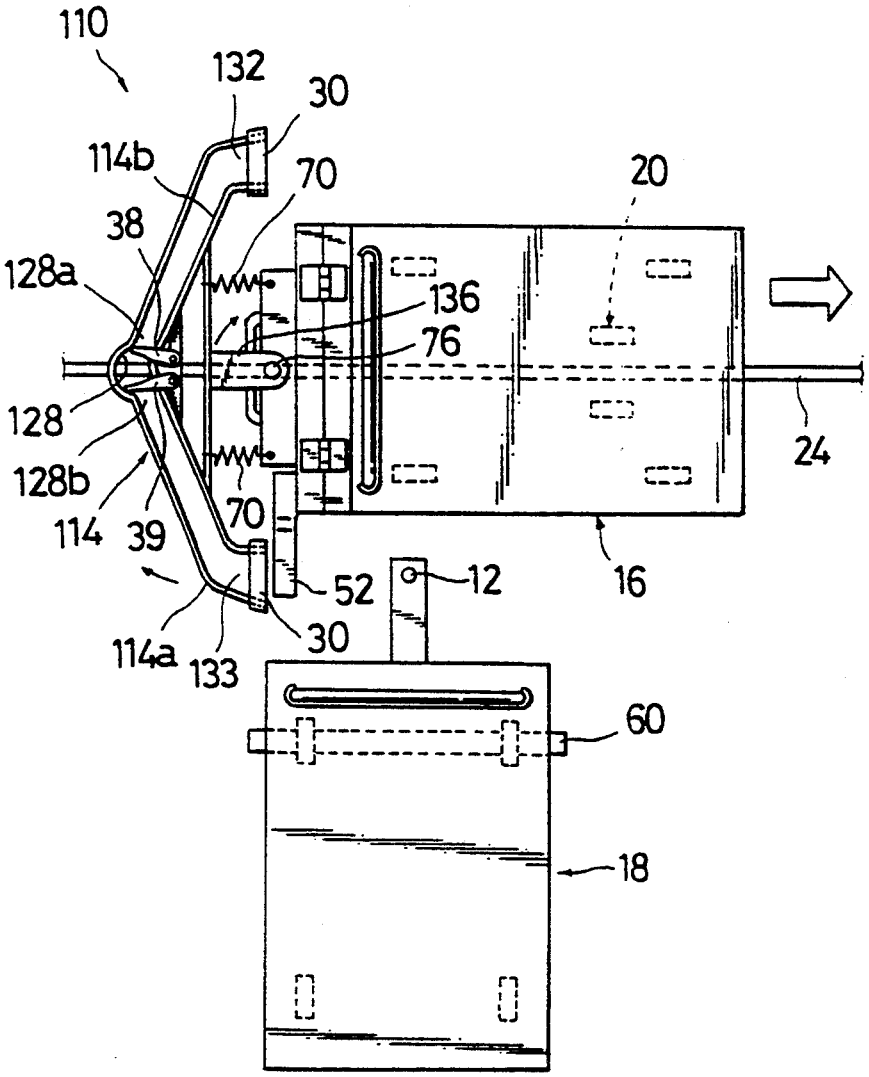
FIG. 11 is a plan view showing the state where the self-propelled truck is about to be coupled with the carrying truck by the second embodiment of device.
Figure 12:
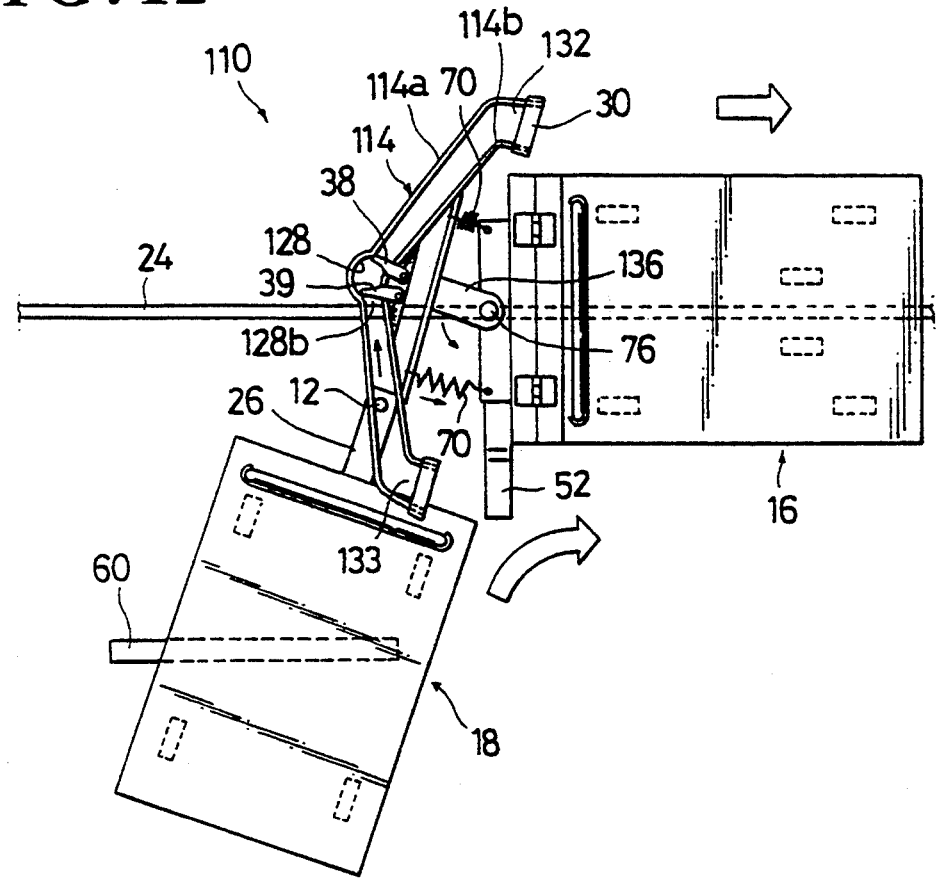
FIG. 12 is a plan view showing the state where the self-propelled truck is being coupled with the carrying tuck by the same device.

According to this embodiment, referring to FIGS. 11 and 12, the waiting line (60) is defined on the floor in parallel with the rectilinear tape (24) and spaced therefrom a distance such that the engagement pin (12) of carrying truck (18) is located at a certain path along which one catching spacing (133) is displaced with the movement of self-propelled truck (16) in the arrow direction in FIG. 11.

Figure 8:
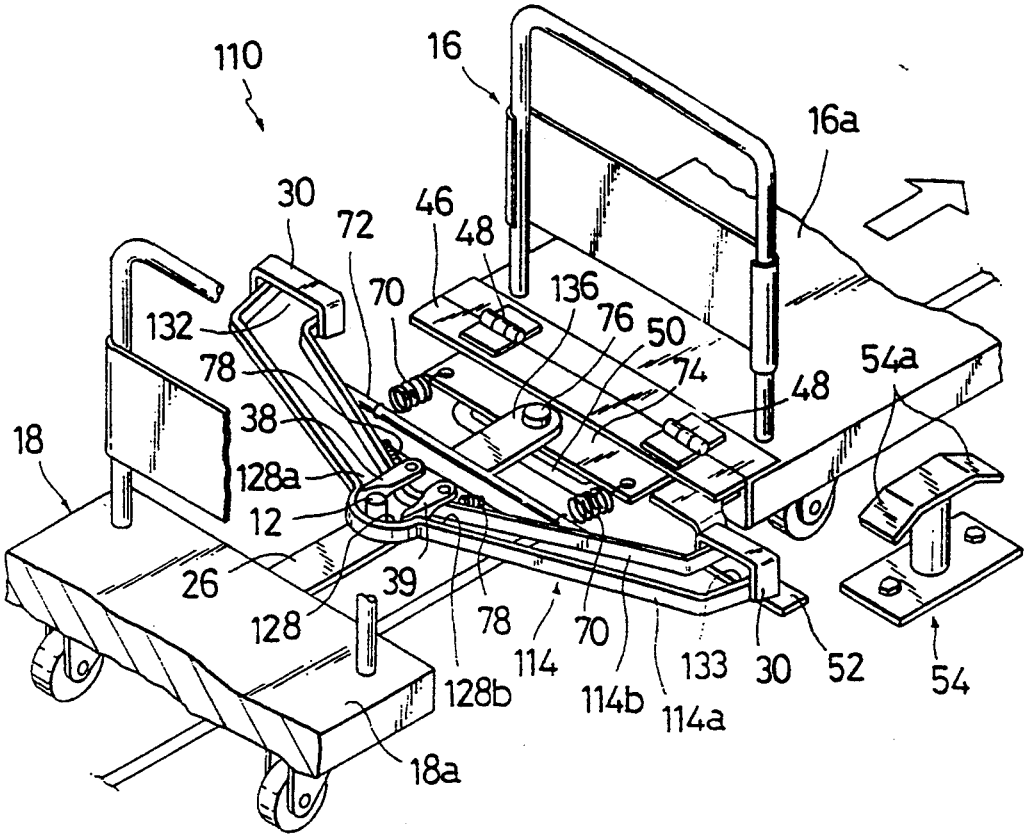
FIG. 8 is a partly broken, schematic perspective view of another embodiment of the device.
Figure 10:
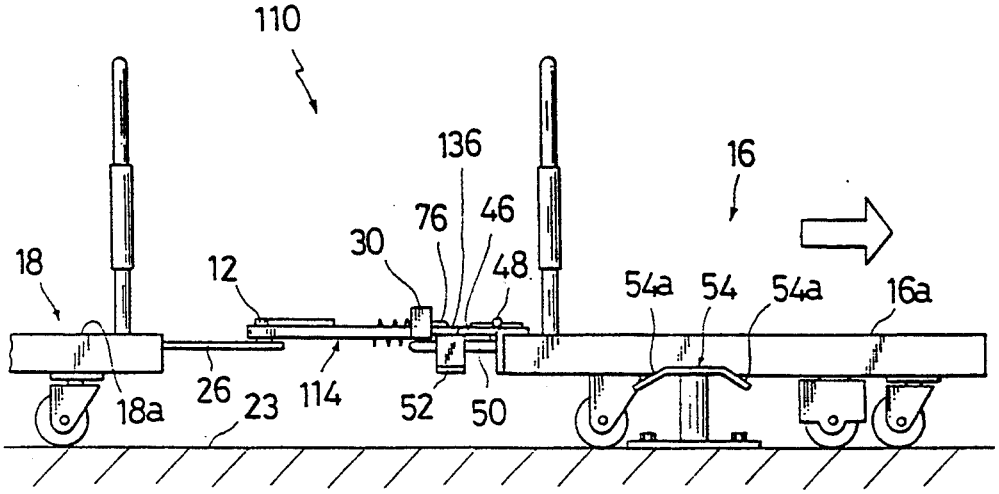
FIG. 10 is a schematic side view showing the same state as in FIG. 9.
Figure 13:
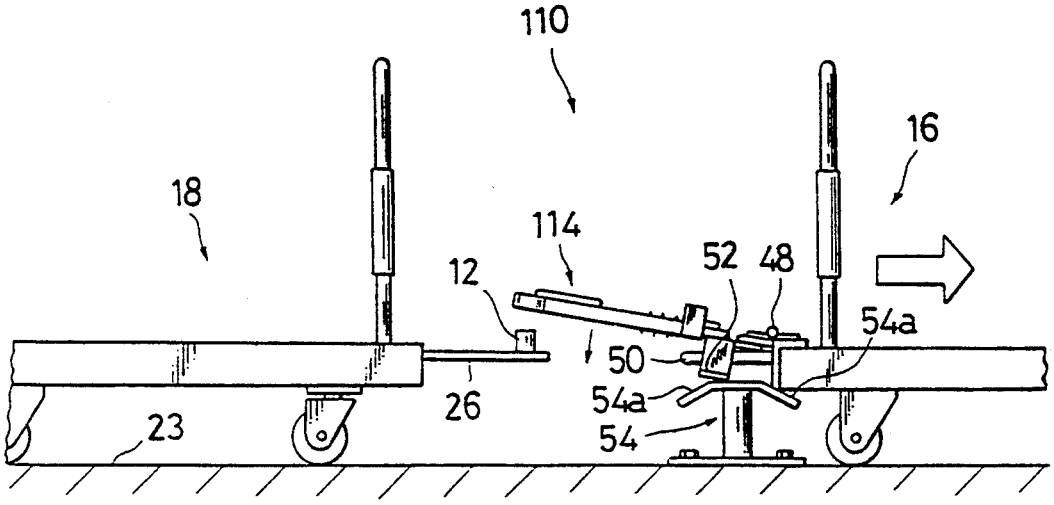
FIG. 13 is a side view showing the uncoupling of the self-propelled truck from the carrying truck.

Then, the pin (12) is caught in that catching spacing (133) and brought to contact with the corresponding wing section of engagement piece (114*a*), at which time, the whole female member (114) is swung clockwise relative to the point (76) as viewed from FIG. 12, since the load from the stopped carrying truck (18) overcomes the pulling force of one of the springs (70). As the leading truck (16) moves on, the carrying truck (18) is drawn thereby, starting to move and thus reducing its load lower than when it has been stopped. Consequently, such reduction of load of carrying truck (18) allows the female engagement member (114) to be swung back to the central point under the equilibrium biasing effect of two springs (70)(70). As a result, the engagement pin (12) slides along the engagement piece (114*a*) and pushes the stopper (39), overcoming the biasing force of spring (78), to open the corresponding narrow spacing (128*b*), so that the engagement pin (12) enters the central engagement spacing (128*b*). Thereafter, the stopper (39) is biasingly rotated back to close that narrow spacing (128*b*), whereupon the coupling of the self-propelled truck (16) with the carrying truck (18) is completed, as in FIG. 8. In this second embodiment also, as shown in FIGS. 10 and 13, the uncoupling of the leading truck (16) from the carrying one (18) is to be effected in the same manner as described in the first embodiment above, by means of the uncoupling arm and stand members (52)(54).

It is noted that, at the waiting line (60), the carrying truck (16) is positioned such as to direct its longitudinal axis in a direction orthgonal with the reclininer tape line (24).

The present second mode of female engagement member (114) may be applicable to the curved point as in the first embodiment.

The above-described laterally swinging motion of female engagement member (114) is effective in drawing the perpendicularly located carrying truck (18) towards the rectilinear line (24), gradually, such that the truck (18) is moved along an arc-like path and oriented in the same direction with the rectilinear tape (24), in a smooth way.

While having described the present invention thus far, it should be understood that the invention is not limited to the illustrated embodiments, but any other modifications, replacements and additions may be applied thereto without departing from the scope and spirit of the appended claims. For example, the female engagement member (14, 114) may be of such structure that it is to be lowered downwardly from the male engagement pin (12) for the uncoupling purpose. Further, on the contrary, the male engagement pin (12) may be movable vertically with respect to the female engagement member (14, 114) for the coupling and uncoupling purpose. The coupling method and device in the present invention may also be applied to a trackless-type self-propelled truck that does not use such guidance tape (24).

What is claimed is:

1. A method for coupling a self-propelled truck with a carrying truck, comprising the steps of:

providing a female engagement means at a rearward side of said self-propelled truck;

providing a male engagement means at a forward side of said carrying truck;

wherein said female engagement means is so formed as to have an engagement base portion for allowing engagement with said male engagement means and retaining the same therein, and a pair of right and left opening means disposed symmetrically relative to and continuous with said engagement base portion;

defining a curved point in a path along which said self-propelled truck moves in a forward direction; and locating said carrying truck adjacent to said curved point, such that said male engagement means provided at the forward side of said carrying truck is positioned at a path along which one of said right and left opening means is to be displaced when said forwardly moving self-propelled truck turns at said curved point, whereby, when said self-propelled truck turns at said curved point, said female engagement means is subject to a swerving motion in respect of a curved line at said curved point, bringing said one of said right and left opening means towards said male engagement means of the thus-located carrying truck, so that said male engagement means is caught in said one of said right and left opening means, and engaged and retained in said engagement base portion of said female engagement means.

2. The method as defined in claim 1, wherein said method further includes the steps of:

defining an uncoupling point;

providing a vertically movable means in one of said male and female engagement means; and causing vertical movement of said one of said male and female engagement means by means of said vertically movable means, when said self-propelled and carrying trucks, which are coupled together, reach said uncoupling point.

3. A method for coupling a self-propelled truck with a carrying truck, comprising the steps of:

providing a female engagement means at a rearward side of said self-propelled truck;

providing a male engagement means at a forward side of said carrying truck;

wherein said female engagement means is so formed as to have an engagement base portion for allowing engagement with said male engagement means and retaining the same therein, and a pair of right and left opening means disposed symmetrically relative to and continuous with said engagement base portion;

wherein said female engagement means is swingable with respect to said self-propelled truck and returnable to a predetermined position under a biasing force of a spring means;

causing the self-propelled truck to travel in a forward direction along a predetermined path;

wherein said right and left opening means are projected beyond respective lateral sides of said self-propelled truck;

locating said carrying truck such that said male engagement means provided at the forward side of said carrying truck is positioned at the path along which one of said right and left opening means is to be displaced when said self-propelled truck moves;

whereby, when said self-propelled truck reaches a point where said carrying truck is located, said male engagement means is caught in said one of said right and left opening means as said female engagement means proceeds in said froward direction, while said female engagement means is being caused to swing away from said predetermined position by a load of said carrying truck, and then as said load is reduced, said female engagement means is returned to said predetermined position under said biasing force of said spring means, causing said male engagement means to be engaged and retained in said engagement base portion of said female engagement means.

4. The method as defined in claim 3, wherein said method further includes the steps of:

defining an uncoupling point;

providing a vertically movable means in one of said male and female engagement means; and causing vertical movement of said one of said male and female engagement means by means of said vertically movable means, when said self-propelled and carrying trucks, which are coupled together, reach said uncoupling point.

5. A device for coupling and uncoupling a self-propelled truck with and from a carrying truck, when used in a system which includes a fixed uncoupling station, comprising:

a male engagement means provided at a forward side of said carrying truck;

a female engagement means provided at a rearward side of said self-propelled truck, said female engagement means including:

(a) a base engagement portion for allowing engagement with said male engagement means and retaining the same therein;

(b) a pair of right and left opening means disposed symmetrically relative to and continuous with said base engagement portion; and (c) a spacing area which communicates said pair of right and left opening means with said base engagement portion;

vertically movable means connected to said female engagement means or to said male engagement means for allowing vertical movement of the engagement means to which it is connected with respect to the other; and arm means connected to the vertically moveable one of said female and male engagement means and projecting therefrom for causing disengagement of said male engagement means and said female engagement means when said arm means is caused to be vertically moved by contact with the fixed uncoupler stand when in use.

6. The device as defined in claim 5, further comprising:

stopper means provided movably on said base engagement portion, said stopper means being biased by a spring means in a direction for closing said spacing area.

7. A device in accordance with claim 6, wherein said female engagement means is fixedly attached to said self-propelled truck, and wherein said pair of right and left opening means do not project beyond the respective lateral sides of said self-propelled truck;

wherein said self-propelled truck turns at a curved point in a path along which it moves, said female engagement means is subject to a swerving motion relative to said curved point, bringing said one of said right and left opening means towards said male engagement means of said carrying truck, so that said male engagement means is caught in said one of said right and left opening means, and engaged and retained in said engagement base portion of said female engagement means by means of said stopper means.

8. The device as defined in claim 5, wherein said device further includes a stand means which is located at an uncoupling point in said path along which said self-propelled and carrying trucks move, and wherein when said two trucks reaches said uncoupling point, said one of said male and female engagement means is caused by said stand means to move vertically, whereby said male engagement means is caused to be disengaged from said female engagement means, to thereby uncouple said self-propelled truck from said carrying truck.

9. The device as defined in claim 5, wherein said male engagement means comprises an engagement pin projected vertically from the forward side of said carrying truck.

10. A device in accordance with claim 5, wherein said female engagement means is swingable on a horizontal plane with respect to said self-propelled truck, and returnable to a pre-determined position under a biasing force of a spring means, and wherein said pair of right and left opening means project beyond the respective lateral sides of said self-propelled truck further open towards a direction in which said truck moves;

wherein when said self-propelled truck reaches a point where said carrying truck is located, said male engagement means is caught in one of said right and left opening means of said female engagement means, while the same female engagement means is being swung, and then engaged and retained in said base engagement portion thereof by the returning action of said female engagement means under said biasing force.

11. A coupling attachment connected to the rearward side of a self-propelled truck for use in a system for the unmanned automatic coupling and uncoupling of the self-propelled truck and a carrying truck having a male engagement means provided at the forward side thereof, comprising:

a central part which defines therein a base engagement means for allowing engagement with the male engagement means of the carrying truck when in use;

a pair of right and left wing parts disposed symmetrically relative to and continuous with said central part, said wing parts defining respectively a right opening and a left opening as well as a spacing area which communicates the pair of right and left openings with said base engagement means;

vertically movable means connected to said base engagement portion for allowing vertical movement of said central member with respect to the male engagement means when in use; and arm means connected to said base engagement portion and projecting therefrom such that when said arm means is caused to be lifted by a fixed uncoupler stand in the path of the self-propelled truck, said arm means and said base engagement portion will be vertically moved, thus uncoupling the self-propelled truck from the carrying truck.

12. A system for the automated transfer of goods and articles and including the automated coupling and uncoupling of a self-propelled truck from a carrying truck without stoppage of the forward progress of the self-propelled truck, comprising:

a self-propelled truck;

guidance means for defining a path along which said self-propelled truck is permitted to travel;

a carrying truck, connectable to said self-propelled truck, including a male engagement means provided at the forward side thereof;

a coupling station at which the carrying truck becomes coupled to the self-propelled truck;

an uncoupling station at which the carrying truck becomes uncoupled from the self-propelled truck, said uncoupling station including a fixed uncoupling stand;

female engagement means connected to a rearward side of said self-propelled truck, including a central part which defines therein a base engagement means for allowing engagement with said male engagement means of said carrying truck and a pair of right and left wing parts disposed symmetrically relative to and continuous with said central part, said wing parts defining respectively a right opening and a left opening as well as a spacing area which communicates the pair of right and left openings with said base engagement means;

vertically movable means connected to said female engagement means or to said male engagement means for allowing vertical movement of the engagement means to which it is connected with respect to the other; and arm means connected to and projecting from the vertically moveable one of said female or male engagement means, for causing disengagement of said vertically movable engagement means from the other when caused to move vertically by contact with said fixed uncoupling stand at said uncoupling station.

13. A method for the automated transfer of goods and articles including the automated coupling of a self-propelled truck from a carrying truck without stopping of the forward progress of the self-propelled truck, comprising:

providing a male engagement pin at the forward end of the carrying truck;

providing a female engagement apparatus connected to the rearward side of the self-propelled truck, including a central part which defines therein a base engagement means for allowing engagement with said male engagement pin of the carrying truck, and a pair of right and left wing parts disposed continuously with said central part, said wing parts defining respectively a right opening and left opening as well as a spacing area which communicates the pair of right and left openings with said base engagement means;

causing the self-propelled truck to travel in a forward direction along a predefined path; and locating the carrying truck adjacent to the path of the self-propelled truck at a predetermined coupling point such that the male engagement pin thereof will enter either the right or left opening of said wing parts and then pass through the spacing area into the base engagement means of said female engagement apparatus as the self-propelled truck proceeds in a forward direction along its path past the coupling point.

14. A method in accordance with claim 13 for the automated transfer of goods and articles including the automated coupling and uncoupling of a self-propelled truck from a carrying truck without stoppage of the forward progress of the self-propelled truck, further including the step of locating a fixed uncoupling stand at a predetermined uncoupling point, and wherein said female engagement apparatus or said male engagement pin further has connected thereto a vertically movable means for allowing vertical movement of the female engagement apparatus or the male engagement pin to which it is connected with respect to the other so as to cause disengagement therebetween when said vertically movable means comes into contact with the fixed uncoupling stand.

15. A method in accordance with claim 13 wherein said locating step comprises locating the carrying truck adjacent to a curved portion of the path of the self-propelled truck such that the male engagement pin is positioned at a point at which one of the right and left openings of the wing parts is to be displaced when the forwardly moving self-propelled truck turns at the curved point;

whereby, when the self-propelled truck turns at the curved portion of the path, the female engagement apparatus is subject to a swerving motion with respect to a curved line at the curved portion, bringing one of the right and left openings toward the male engagement pin of the carrying truck, so that the male engagement pin is caught in one of the right and left opinings and engaged by the base engagement means of the female engagement apparatus.

16. A method in accordance with claim 15 for the automated transfer of goods and articles including the automated coupling and uncoupling of a self-propelled truck from a carrying truck without stoppage of the forward progress of the self-propelled truck, further including the step of locating a fixed uncoupling stand at a predetermined uncoupling point, and wherein said female engagement apparatus or said male engagement pin further has connected thereto a vertically movable means for allowing vertical movement of the female engagement apparatus or the male engagement pin to which it is connected with respect to the other so as to cause disengagement therebetween when said vertically movable means comes into contact with the fixed uncoupling stand.

17. A method in accordance with claim 13, wherein the female engagement apparatus is swingable with respect to the self-propelled truck and includes spring means for biasing the female engagement apparatus to return to a predetermined position, and wherein the right and left openings of the wing parts project beyond the respective lateral sides of the self propelled truck;

whereby, when the self-propelled truck reaches the predetermined coupling point, the male engagement pin is caught in one of the right and left openings thereby causing the female engagement apparatus to swing away form the predetermined set position by the load of the carrying truck, and then, as the load is reduced, the female engagement apparatus is returned to the predetermined position under the biasing force of the spring means, causing the male engagement pin to be engaged by the base engagement means of the female engagement apparatus.

18. A method in accordance with claim 17 for the automated transfer of goods and articles including the automated coupling and uncoupling of a self-propelled truck from a carrying truck without stoppage of the forward progress of the self-propelled truck, further including the step of locating a fixed uncoupling stand at a predetermined uncoupling point, and wherein said female engagement apparatus or said male engagement pin further has connected thereto a vertically movable means for allowing vertical movement of the female engagement apparatus or the male engagement pin to which it is connected with respect to the other so as to cause disengagement therebetween when said vertically movable means comes into contact with the fixed uncoupling stand.

* * * * *